United States Patent [19]

Hahm

[11] 4,441,665

[45] Apr. 10, 1984

[54] AXIALLY TELESCOPIC COIL CARRIER

[75] Inventor: Gerhard H. Hahm, Aachen, Fed. Rep. of Germany

[73] Assignee: Jos. Zimmerman, Aachen, Fed. Rep. of Germany

[21] Appl. No.: 366,326

[22] Filed: Apr. 7, 1982

[30] Foreign Application Priority Data

Apr. 10, 1981 [DE] Fed. Rep. of Germany ... 8110872[U]

[51] Int. Cl.[3] ..... B65H 49/00; B65H 75/20

[52] U.S. Cl. ..... 242/129; 242/118.1

[58] Field of Search ..... 242/129, 118–118.2, 242/118.11; 68/189, 198, 199

[56] References Cited

U.S. PATENT DOCUMENTS

| | | | |
|---|---|---|---|
| 3,826,444 | 7/1974 | Hahm | 242/118.11 |
| 4,078,740 | 3/1978 | Hahm et al. | 242/118.11 |
| 4,180,219 | 12/1979 | Becker et al. | 242/118.1 |
| 4,349,165 | 9/1982 | Henning et al. | 242/118.11 |

*Primary Examiner*—Leonard D. Christian

*Attorney, Agent, or Firm*—Lalos, Leeds, Keegan, Lett & Marsh

[57] ABSTRACT

In an axially telescopic coil carrier comprising a plurality of parts for receiving threads or yarns, wherein carrier elements extending from a respective ring element extend lengthwise of the coil carrier, from a substantially cylindrical surface and are guided for displacement relatively to each other, reinforced sections are provided near the ring members in which adjacent carrier elements are connected to each other by circumferential supporting elements. The free ends of the carrier elements project axially beyond these reinforced sections. At least a part of the supporting element of each coil carrier part projects, at least in that zone of the reinforced section which is remote from the associated ring member, radially no more than into the surfaces on which the inner edges of the free ends of the carrier elements of the adjacent coil carrier part are disposed. The supporting elements thus form radially effective supports for these free ends of the carrier elements. The side faces of the carrier elements of one coil carrier part come to lie against the side faces of the carrier elements of the adjacent coil carrier part, at least each second of the circumferentially juxtaposed carrier elements of two coil carrier parts being provided with radial apertures (FIG. 1).

15 Claims, 18 Drawing Figures

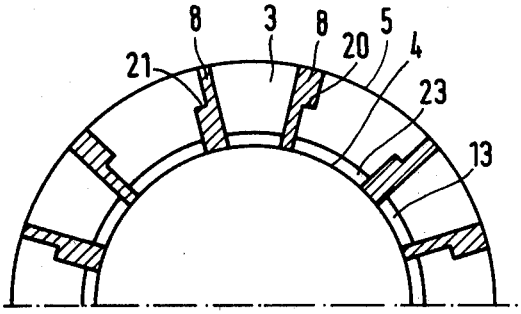
FIG. 6
FIG. 7
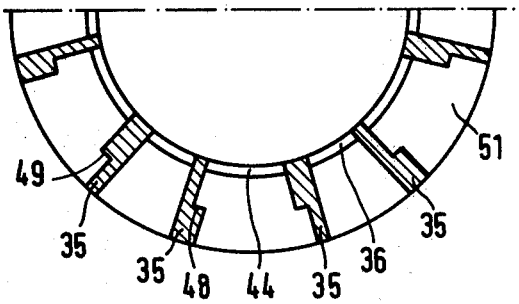
FIG. 9
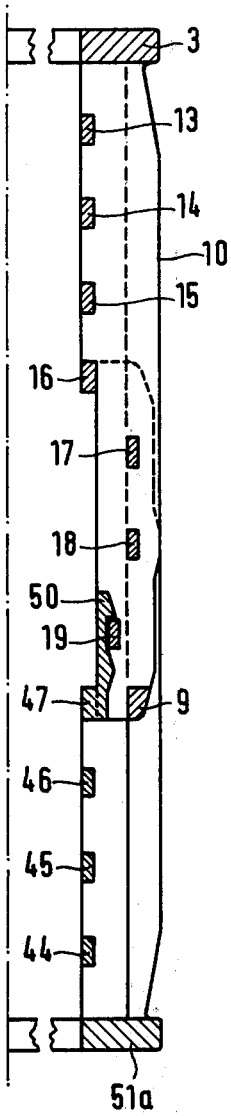
FIG. 8
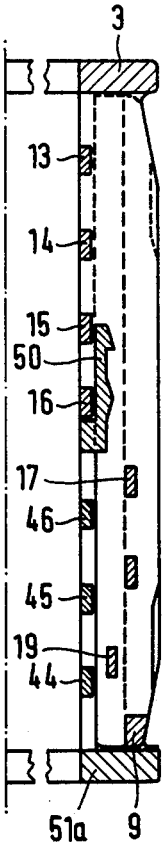

FIG. 17
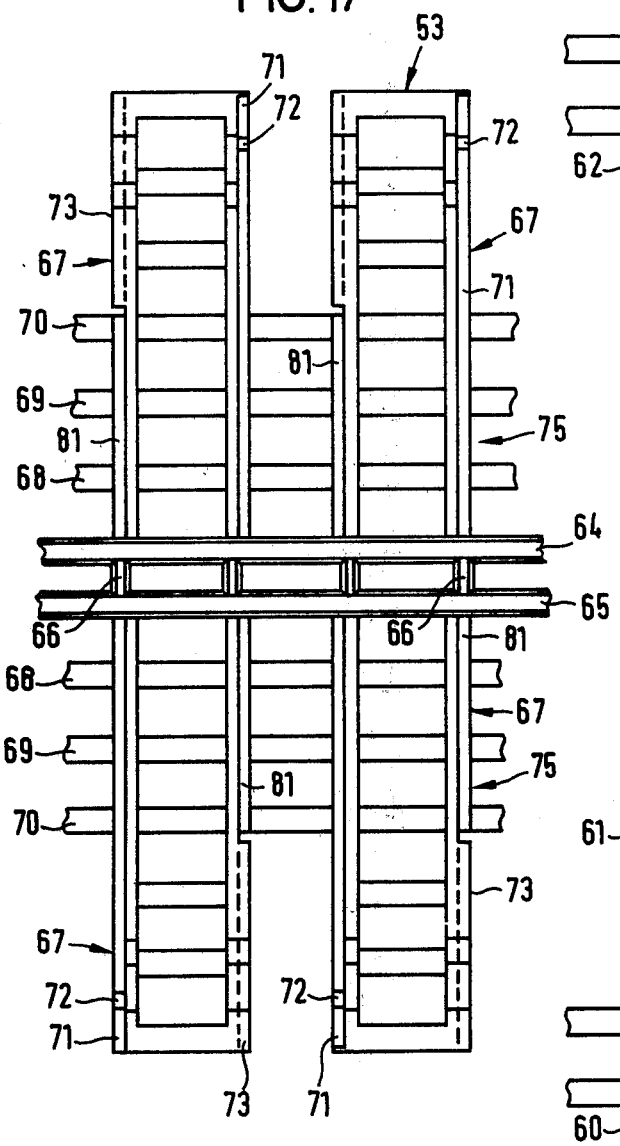
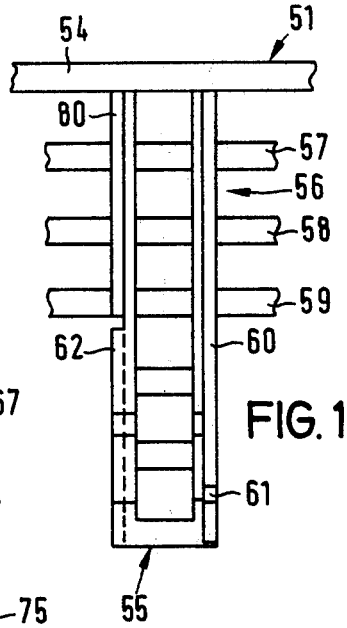
FIG. 16
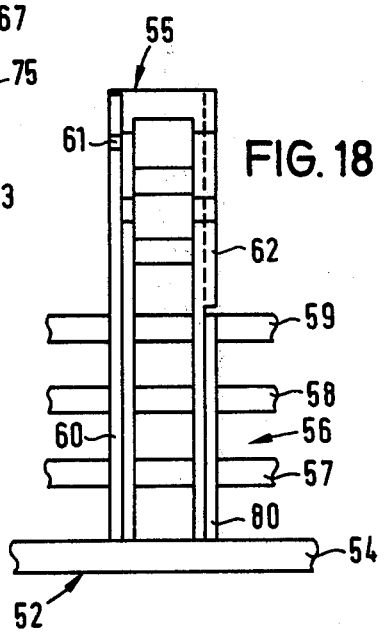
FIG. 18

AXIALLY TELESCOPIC COIL CARRIER

The invention relates to an axially telescopic coil carrier for receiving threads or yarns comprising a first and a second end ring and carrier elements which are secured with a respective one end to one end ring, form a substantially cylindrical surface, extend lengthwise of the coil carrier and are guided for displacement relatively to each other.

Such a coil is already known (DE-GM No. 71 92 230) in which a plurality of carrier elements extending parallel to the axis of the coil carrier is uniformly distributed over the circumference of the one end ring, one longitudinal side of the carrier elements having a radially inwardly directed guide shoulder and the other longitudinal side a radially outwardly directed guide shoulder. The carrier elements secured to the other end ring are securely interconnected at the inside by a ring in the region of their free ends and are disposed between the carrier elements of the one end ring. The guide shoulders of the carrier elements secured to the one end ring co-operate with the guide shoulders of the carrier elements secured to the other end ring.

In this known coil carrier, it is, inter alia, a disadvantage that the carrier elements secured to the two end rings are securely guided circumferentially as well as radially only in the region of the supporting ring. The ring constitutes reinforcement for the associated coil carrier part so that this coil carrier part exhibits different stability properties than does the other coil carrier part. Care must be taken that the ring in the initial position of the known coil carrier is disposed substantially centrally between the two end rings but that, with the coil carrier partially telescoped, the ring is disposed off-centre and the stiffness in the individual sections of the entire coil carrier thus depends on the degree to which the two coil carrier parts are telescoped.

It is the problem of the present invention to avoid the disadvantages of the known coil carrier and in particular to provide a coil carrier which, with a high degree of stiffness, ensures reliable guiding of the two coil carrier parts, the stability distribution of the entire coil carrier being in each position substantially symmetrical to the medial plane extending centrally between the end rings, whereby the strength is increased by telescoping the coil carrier parts.

This problem is solved according to the invention in a coil carrier of the aforementioned kind in that reinforced sections are provided near the ring members, in which adjacent carrier elements are connected to each other by circumferential supporting elements and beyond which the free ends of these carrier elements project axially, that at least a part of the supporting elements of each coil carrier part projects, at least in that zone of the reinforced section which is remote from the associated ring member, radially no more than into the surfaces on which the inner edges of the free ends of the carrier elements of the adjacent coil carrier part are disposed and thus forms radially effective supports for these free ends of the carrier elements, and that the side faces of the carrier elements of each coil carrier part come to lie against side faces of the carrier elements of the adjacent coil carrier part, at least each second of the circumferentially juxtaposed carrier elements of two coil carrier parts being provided with radial apertures.

This coil carrier has a high stability particularly in the region of its reinforced section, it being possible for the supporting elements to be formed by parts of a perforated outer wall or by individual webs. In any desired position, the stability distribution of this coil carrier remains symmetrical to the medial plane and the strength is increased during telescoping. The free ends of the carrier elements of the one coil carrier part are positively guided between the carrier elements of the other coil carrier part in the region of its reinforced section. Such a construction of coil carrier ensures that, after use, it can be returned to its starting position for re-use.

All the carrier elements can be provided with radial apertures. However, it is also possible that, of every two circumferentially adjacent co-operating carrier elements, only one is provided with such apertures. The carrier elements not provided with apertures desirably have only relatively small dimensions in the circumferential direction. Every carrier element is reliably guided at its free end by the two circumferentially adjacent carrier elements of the opposite coil carrier part as well as by at least one supporting element.

The two end rings can be so constructed that their circumferential surface is disposed in the cylindrical surface formed by the outer faces of the carrier elements. However, it is possible for the circumferential surface of the end rings to project beyond the cylindrical surface.

According to a further suggestion of the invention, the coil carrier can be so constructed that the side faces of the carrier elements are substantially disposed in planes extending radially with respect to the coil carrier axis.

According to a further suggestion of the invention, the coil carrier can be so constructed that the side faces of each carrier element of one of two co-operating coil carrier parts extend parallel to each other.

According to a further suggestion of the invention, the coil carrier can be so constructed that each carrier element comprises, at least at one side face, radially inwardly or radially outwardly directed guide face co-operating with a radially outwardly or radially inwardly directed guide face provided at one side face of a carrier element of the adjacent coil carrier part. This achieves additional precision for mutual guiding of the carrier elements.

According to a further suggestion of the invention, the coil carrier can be so constructed that the supporting elements of the reinforced sections are each formed by at least two axially spaced ring segments extending between the carrier elements. At least that ring segment which is furthest from the associated end rings lies radially within the surfaces on which the inner edges of the free ends of the carrier elements of the oppositely disposed coil carrier part are arranged. Consequently, the carrier elements of the one coil carrier part can be axially pushed over at least one supporting element of the opposite coil carrier part.

According to a further suggestion of the invention, the coil carrier can be so constructed that the supporting elements between every two carrier elements are coupled by at least one substantially axially parallel slide web which continuously adjoins the outer faces of the supporting elements. These slide webs ensure that, if the coil carrier parts are slightly oblique to each other, the free ends of the carrier elements of one coil carrier part will be prevented from striking the supporting elements of the other coil carrier part. In addition, the slide webs can be so placed that they assist guiding of the carrier elements at both sides.

According to a further suggestion of the invention, the coil carrier can be so constructed that the outer faces of the carrier elements are set back radially inwardly at their free ends. In this way it is ensured that, upon telescoping the coil carrier parts, they move beneath and therefore do not damage the inner layers of the coil of yarn on the coil surface. At the same time, the free ends of the carrier elements thus formed are entirely or at least partially relieved by a radially inwardly effective pressure of the coil. This pressure is then received in the region of the free ends either entirely or at least predominantly by the reinforced section.

According to a further suggestion of the invention, the coil carrier can be so constructed that at least at one of every two cooperating coil carrier parts at least one resiliently yielding snap element is provided which loosely co-operates in the initial position of the coil carrier with a counter-member of the other coil carrier part. When the coil carrier has been axially compressed, it can subsequently be returned to its initial position and there be correctly and loosely fixed by means of the snap element.

According to a further suggestion of the invention, the coil carrier can be so constructed that each snap element is a spring tongue which is disposed between two carrier elements of one coil carrier part and which engages resiliently beneath a counter-member of the axially adjacent coil carrier part. It is possible to provide as many snap elements as there are carrier elements.

However, it is also conceivable to provide fewer snap elements. Further, it is possible to provide the snap elements always at only one coil carrier part whereas the counter-members are disposed at the other coil carrier part.

According to a further suggestion of the invention, the coil carrier may be made in two parts and comprise two head portions provided with end rings.

According to a further suggestion of the invention, the coil carrier can be made in three parts. In this construction, in which the two head portions are desirably identical, it is possible to achieve a longer axial length for the coil carrier by using a longer central portion. As a result, only a single second mould is required. In contrast, for a two-part coil carrier two further moulds are required if it is to be produced in a different axial length.

According to a further suggestion of the invention, the coil carrier can be so constructed that the outer faces of the carrier elements are radially inwardly inclined near the end rings of the two head portions. This achieves that the coil of yarn is fixed at its points of reversal and the layers of yarn will not slip towards the axial centre. In addition, this ensures that a coil cannot be displaced beyond the end ring.

According to a further suggestion of the invention, the coil carrier can be so constructed that the ring member of the central portion is disposed substantially at the longitudinal centre thereof and adjoins carrier elements at both sides. Consequently, a throughgoing continuous annular face is created in the central zone of the coil carrier that can co-operate well with a spool drum.

According to a further suggestion of the invention, the coil carrier can be so constructed that the ring member of the central portion is of roller form. In this embodiment, co-operation of the coil carrier with a slotted spool drum is further improved.

According to a further suggestion of the invention, the coil carrier can be so constructed that the ring member of the central portion is divided into a plurality of rings disposed in parallel planes.

Some embodiments of the coil carrier according to the invention will now be described with reference to the drawings, wherein:

FIG. 6 is a section through the coil carrier part illustrated at the top of FIG. 1 on the line 6—6 in FIG. 1;

FIG. 7 is a section through the coil carrier part illustrated at the bottom of FIG. 1 on the line 7—7 in FIG. 1;

FIG. 8 is a part-section through a telescoped coil carrier on the line 8—8 in FIG. 4;

FIG. 9 is a view similar to FIG. 8 in which the two coil carrier parts are in their original position;

FIG. 16 is a fragmentary elevation of the upper coil carrier part, in which only part of the end ring as well as one carrier element are illustrated;

FIG. 17 is a fragmentary elevation of the central coil carrier part in which part of a ring member with two carrier elements at both sides are illustrated in a developed form and FIG. 18 is a fragmentary elevation of the lower coil carrier part in which only a part of the end ring as well as one carrier element are illustrated.

Figure 1:
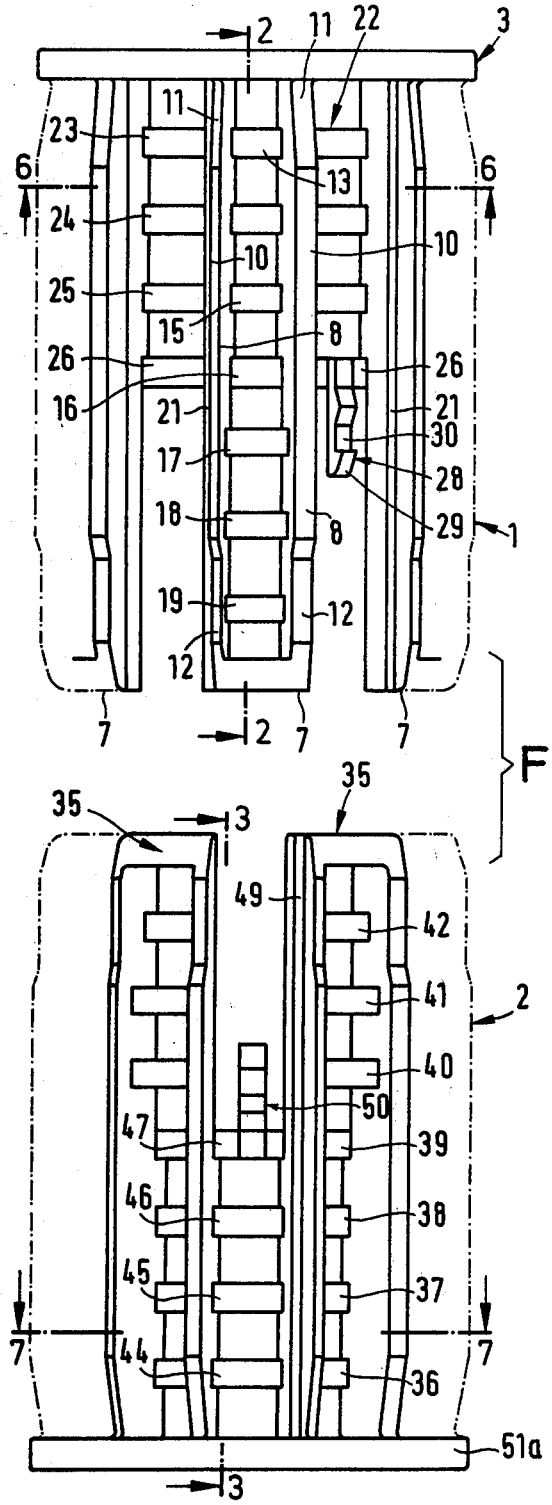
FIG. 1 is a side elevation of a coil carrier constructed in accordance with the invention and showing two coil carrier parts in exploded view.
Figure 2:
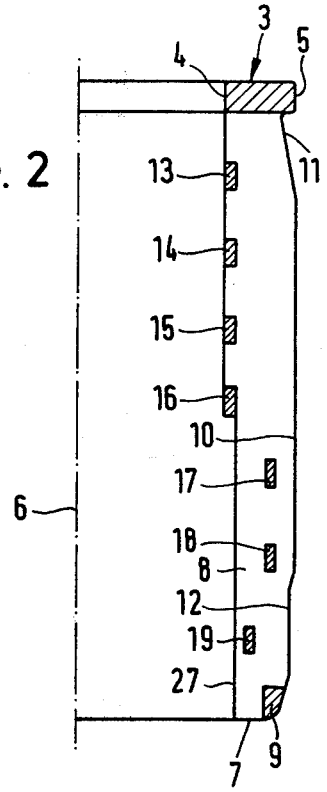
FIG. 2 is a part-section on the line 2—2 in FIG. 1.
Figure 3:
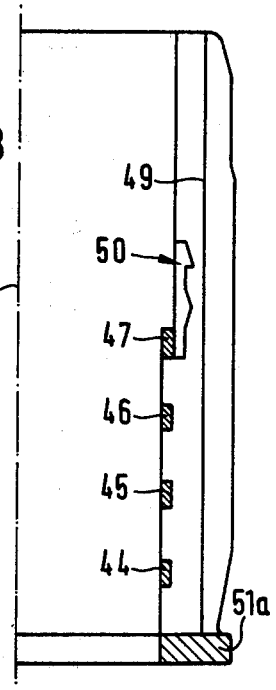
FIG. 3 is a part-section on the line 3—3 in FIG. 1.
Figure 4:
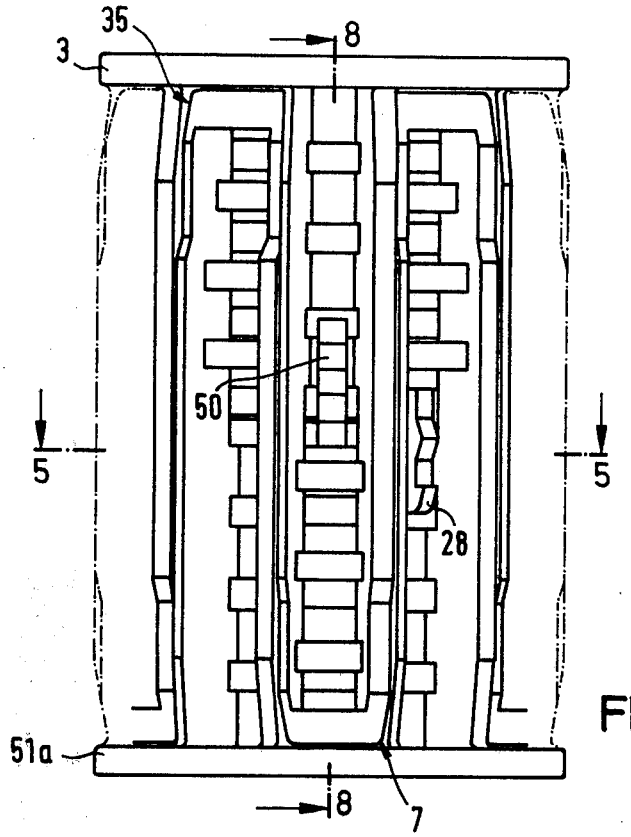
FIG. 4 is a side elevation of the FIG. 1 coil carrier according to the invention in the maximum telescoped position.
Figure 5:
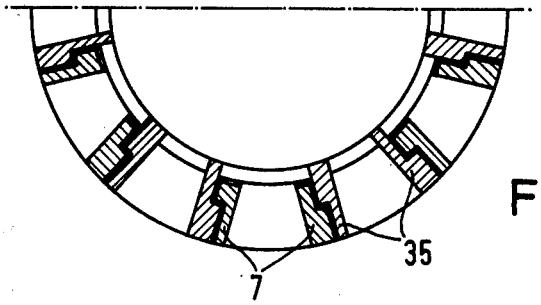
FIG. 5 is a part-section of the telescoped coil carrier on the line 5—5 in FIG. 4, the spring tongues as well as the webs connecting the side portions of the carrier elements being omitted.
Figure 12:
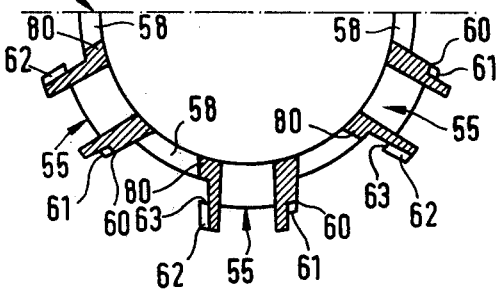
FIG. 12 is a part-section through the coil carrier part shown at the top of FIG. 10 in the plane 12 in the direction of the arrow A.
Figure 13:
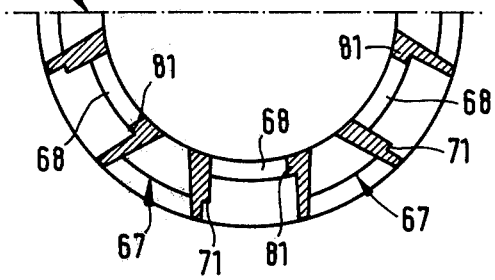
FIG. 13 is a part-section through the central coil carrier part of FIG. 10 in the plane 13 in the direction of the arrow B.
Figure 14:
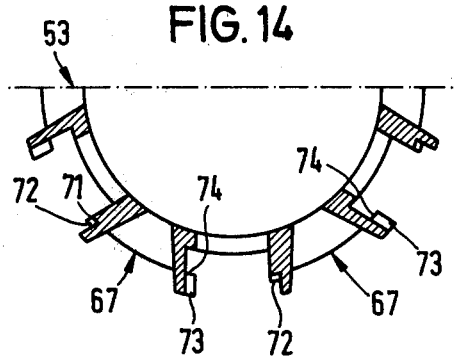
FIG. 14 is a part-section through the central coil carrier part of FIG. 10 in the plane 14 in the direction of the arrow C.
Figure 15:
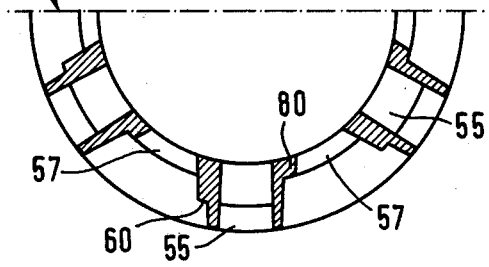
FIG. 15 is a part-section through the lower coil carrier of FIG. 10 in the plane 15 in the direction of the arrow D.

The coil carrier shown in the drawings comprises two coil carrier parts 1, 2. The coil carrier part 1 has an end ring 3 with a cylindrical inner surface 4 as well as a cylindrical outer surface 5. It is concentric with the longitudinal axis 6 of the coil carrier. Carrier elements 7 parallel to the coil carrier axis 6 are uniformly distributed over the circumference and extend from the end ring 1. Each carrier element 7 is formed by two substantially parallel side portions 8 which are interconnected at the free ends of the carrier elements 7 by a cross-member 9. The two side portions 8 of the carrier elements 7 have outer surfaces 10 which lie on a common cylindrical surface in which the outer surface 5 of the end ring 3 is also disposed in the described example. In the region of the connection to the end ring 3, these outer surfaces 10 are radially inwardly declined towards the end ring 3 at 11. The outer surfaces 10 of the carrier elements 7 are set back radially inwardly at 12 in the region of their free ends.

The two side portions 8 are, in addition to the cross-member 9, connected by a row of circumferential webs 13–19. The side faces extend substantially radially of the coil carrier axis 6.

The two side portions 8 of each carrier element 7 have circumferentially projecting guide shoulders (FIG. 6) of which the shoulder 20 of the one side portion 8 is directed radially inwardly and the shoulder 21 of the other side portion 8 radially outwardly.

Circumferentially adjacent carrier elements 7 are rigidly interconnected in a reinforced section 22 near the end ring 3 by axially spaced circumferentially extending annular supporting elements 23–26. The supporting elements 23–26 are circumferentially aligned with the webs 13–16 between the side portions 8 of the carrier elements 7. This aligned arrangement results in rings and, in conjunction with the carrier elements, in a stiff cage. Although such an arrangement is advantageous, the aligned arrangement of these elements is by no means essential.

The carrier elements 7 project beyond the reinforced section 22 defined by the supporting elements 23–26. The inner edges 27 of the free ends of the carrier elements 7 are disposed in the same surfaces as are the outer faces of the supporting elements 23–26 or are slightly outwardly offset with respect thereto so that additional guiding is provided at this position. The web 19 near the free ends of the carrier elements 7 is arranged furthest radially inwardly. The webs 17 and 18 are radially outwardly offset in relation thereto.

Solely for reasons of moulding technique, it may be desirable to offset the webs 13–19 radially with respect to each other. The same may apply to the supporting elements 23–26.

In the coil carrier part 1, a spring tongue 28 projects radially between two carrier elements 7. It has a slide face 29 which, starting from its free end, rises gradually and is set back abruptly in a recess 30, again rises radially outwardly and then converges gradually radially inwardly. The spring tongue 28 can be elastically deformed radially inwardly by applying a suitable pressure.

Only one spring tongue 28 is shown for the coil carrier part 1 in FIG. 1. It is possible to provide further such tongues.

The coil carrier part 2 has substantially the same construction as that of the coil carrier part 1. Thus, it has carrier elements 35 with webs 36–42 which connect the side portions of the carrier elements, and an end ring 51*a*. The connection between adjacent carrier elements 35 is ensured by supporting elements 44–47. A spring tongue 50 of the described kind is securely connected to one supporting element 47.

The side portions of the carrier elements 35 are, in the same way as described for the carrier elements 7, provided with a radially inwardly directed shoulder 48 or with a radially outwardly directed shoulder 49 (FIG. 7). The circumferential spacing of the carrier elements 7 of the coil carrier part 1 is such that a carrier element 35 can engage between two carrier elements 7, one radially outwardly directed shoulder of the one carrier element co-operating with a radially inwardly directed shoulder of the other carrier element. Of course the same applies to the spacing between the carrier elements 35 of the second coil carrier part 2.

In the construction as particularly shown in FIG. 9, a spring tongue 50 of the coil carrier part 2 engages under the web 19 of a carrier element 7 of the first coil carrier part 1. If, now, pressure is exerted in the axial direction on one of the two coil carrier parts 1, 2, the spring tongues 28, 50 as well as any further spring tongues provided on one or both coil carrier parts 1, 2 are deformed radially inwardly and therefore escape the web 19 so that the two coil carrier parts 1, 2 can be axially telescoped. In the original position, the inner edges 27 of the carrier elements 7, 35 of the coil carrier parts 1, 2 are disposed with their ends directly radially beyond the supporting element 26 which in this zone in conjunction with the side portions of the carrier elements 7, 35 thus produces a reliable guide between one carrier element of one coil carrier part and two carrier elements of the oppositely disposed coil carrier part. If, now, the two coil carrier parts 1, 2 are pushed into each other, the free ends of the carrier elements 7, 35 slide over the supporting elements 26–23 or 47–44. However, the supporting elements adjacent the respective end ring 3, 51*a* may also project into the path of the free ends of the carrier elements 7, 35 and thereby define the extent to which the two coil carrier parts 1, 2 can be telescoped. The tongues are likewise disposed radially outwardly of these supporting elements. If, now, this coil carrier is to be returned to its starting position after one working operation, it is merely necessary to pull the two coil carrier parts 1, 2 apart until the spring tongues 28 or 50 re-engage the webs 42 or 19 and limit drawing-apart of the two coil carriers.

A further embodiment of the coil carrier according to the invention will now be described with reference to FIGS. 10 to 18. This embodiment differs from the previously described one particularly in that the coil carrier is here constructed of three parts. It comprises an upper head portion 51, a lower head portion 52 as well as a central portion 53. The two head portions 51, 52 are identical and can therefore be made in a single mould. The head portions substantially correspond in their construction to the coil carrier parts 1 or 2 of the previously described embodiment. They each have an end ring 54 from which uniformly circumferentially distributed carrier elements 55 extend parallel to the axis of the coil carrier as previously described. Near the end ring 54, both head portions 51, 52 have reinforced section 56 in which adjacent carrier elements 55 are interconnected by supporting elements 57, 58, 59. These supporting elements are in the form of ring elements. The supporting elements 57, 58, 59 are intercoupled by a slide web 80 which is substantially parallel to the carrier elements 55 and continuously adjoins the outer faces of the supporting elements. In the illustrated embodiment, the slide web 80 is disposed directly at the side of one carrier element 55 at which the guide web 62 is located. It therefore contributes to improving the mutual guiding of the carrier elements 55, 67.

At one side, the carrier elements 55 have outwardly directed guide shoulder 60 which extends over the entire length of the carrier elements 55 and exhibits a lug 61 near the end of the carrier elements. This lug gradually rises as viewed from the free end of the respective carrier element 55 and is then abruptly set back radially inwardly.

On the other side, each carrier element 55 has a circumferentially projecting guide web 62 with a radially inwardly directed guide shoulder 63. The guide web 62 extends from the free end of the carrier element 55 and terminates at a spacing from the reinforced section 56. The side faces of each carrier element 55 of the head portions are parallel in the case of the described embodiment.

At its axial centre, the central portion 53 has two rings 64, 65 which are concentric with the coil carrier axis and of which the external diameter is equal to the external diameter of the end rings 54 of the head portions 51, 52 in the illustrated example. The two rings 64, 65 are rigidly intercoupled by webs 66.

Identical carrier elements 67 extend from both sides of the ring member formed by the rings 64, 65. Near the ring member, circumferentially adjacent carrier elements 67 are rigidly coupled by supporting elements 68, 69, 70 also in the case of the central portion 53, so that reinforced sections 75 are here created.

Each carrier element 67 has a radially outwardly directed guide shoulder 71 at one side. Near the free end of each carrier element 67, a lug 72 is provided on the shoulder. The guide shoulder 71 extends over the entire length of the respective carrier element. It substantially corresponds to the guide shoulder 60 of the head portions 51, 52. On the other side, each carrier element 67 of the central portion 53 has a guide web 73 which forms a radially inwardly directed guide shoulder 74. The guide web 73 of each carrier element 67 extends from the free end up to near the reinforced section 75 formed by the supporting elements 68, 69, 70. It is comparable with the guide web 62 of the carrier elements 55.

The spacings between two circumferentially adjacent carrier elements 67 are such that a carrier element 55 of the head portions 51, 52 can be guidingly engaged between these carrier elements 67 of the central portion 53, in which case the outwardly directed guide shoulder 60 of the carrier element 55 of the head portions 51, 52 will then co-operate with the radially inwardly directed guide shoulder 74 of the carrier elements 67 of the central portion 53. In an analogous manner, the radially inwardly directed guide shoulder 63 of the carrier elements 55 of the head portions 51, 52 will co-operate with the radially outwardly directed guide shoulder 71 of the carrier elements 67 of the central portion 53. In addition, the supporting elements 57, 58, 59 or 68, 69, 70 will provide a further guide for the free ends of the carrier elements 67 or 55, respectively.

Figure 10:
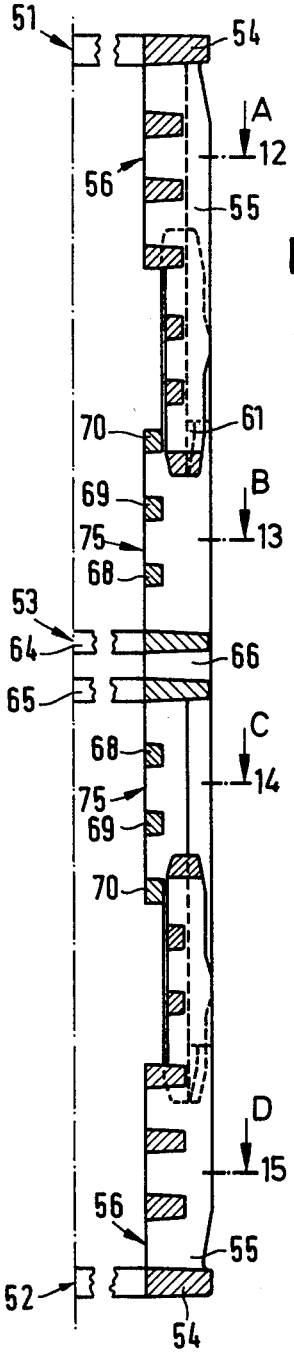
FIG. 10 is a part-section similar to FIG. 9 through a coil carrier according to the invention made in three parts and in the original position.
Figure 11:
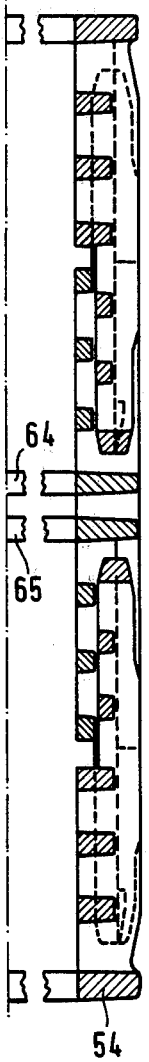
FIG. 11 is a view similar to FIG. 10 of the coil carrier in a telescoped position.

In FIG. 10 starting position of the coil carrier, the free ends of the carrier elements 55 of the head portions 51, 52 lie on the supporting elements 70 of the central portion 53 whilst the free ends of the carrier elements 67 of the central portion 53 similarly rest on the supporting elements 59 of the head portions 51, 52. The lugs 61 and 72 of the carrier elements 55, 67 in this position engage behind that end of the guide webs 62, 73 which faces the ring member 64, 65 of the central portion 53 and thus prevent unintentional separation of the three parts of the coil carrier.

In a departure from the embodiment described with reference to FIGS. 10 to 18, the central portion can be constructed so that the carrier elements on the one side of the ring member are adapted to the guide slot formed between the carrier elements on the other side of this ring member. It follows that, when this part is separated at the longitudinal centre, two telescopable coil carrier parts are created. Starting with this part which can be made in one mould, two-part and multi-part coil carriers can thus be produced without the need for an additional mould.

I claim:

1. An axially telescopic coil carrier for receiving a coil or spool of thread or yarn, said coil carrier having a number of coil parts which are telescopically displaceable on with respect to the other, and ones of said coil carrier parts having a respective end ring element and a plurality of carrier elements extending longitudinally of the respective coil carrier part from said end ring element to form susbtantially cylindrical surfaces, the improvement comprising:

first and second reinforced section means placed, respectively, adjacent to the end ring members of said end coil carrier parts for connecting adjacent carrier elements to each other to form circumferential supporting elements, respective free ends of said carrier elements extending axially therefrom to the zone of the opposed one of said end ring elements, means forming radial support means for free ends of the respective carrier elements, said being respectively shaped such that the side basis of the carrier elements of each said coil carrier part abut opposed side faces of carrier elements of the opposed coiled carrier part so that at least each second one of the circumferentially juxtaposed carrier elements of the two coil carrier parts are provided with radial apertures.

2. The improved coil carrier defined in claim 1 wherein the side faces of said carrier elements are substantially disposed in planes extending radially with respect to the axis of the coil carrier.

3. The improved coil carrier defined in claim 1 wherein the side faces of each said carrier element of one of two cooperating coil carrier parts are parallel.

4. The improved coil carrier defined in claim 1 wherein each said carrier element has at least one side face, one of a radially inwardly or outwardly directed guideface cooperating with a radially outward or inwardly directed guideface provided at a side face of a carrier element of the adjacent coil carrier part.

5. The improved coil carrier defined in claim 1 wherein said supporting elements of said reinforced sections are each formed by at least two axially spaced ring segments extending between the respective said carrier elements.

6. The improved coil carrier defined in claim 5 further comprising a plurality of axially parallel slide webs which continuously join the outer faces of said supporting elements and are arranged between every two carrier elements.

7. The improved coil carrier defined in claim 1 wherein the outer surface of said carrier elements are set back radially inwardly at the free ends thereof.

8. The improved coil carrier defined in claim 1 further comprising at least one resiliently yielding snap element on at least one of said two coil carrier parts and at least one releasably cooperating receiving member for said snap element on the other of coil carrier parts.

9. The improved coil carrier defined in claim 8 wherein said snap element is a spring tongue-shaped member which is disposed between two adjacent carrier elements on said one coil carrier part for resiliently engaging said receiving member of an axially adjacent coil carrier part.

10. The improved coil carrier defined in claim 8 wherein ones of said carrier elements include outwardly directed guide shoulders and wherein said snap element is formed by a lug member located on one of said outwardly directed guide shoulders, said receiving means being arranged behind the end of a said guide web at the adjacetn carrier element.

11. The improved coil carrier defined in claim 1 wherein said member of said coil carrier parts is three parts.

12. The improved coil carrier defined in claim 11 wherein in said end carrier parts the outwardly facing surfaces of said carrier elements adjacent said end rings extend at a radially inward inclination.

13. The improved coil carrier defined in claim 12 wherein the central of said coil carrier parts includes a ring member which is disposed substantially at the longitudinal center thereof, the outer surface thereof being attached to inner portions of said carrier elements.

14. The improved coil carrier described in claim 12 wherein said ring member of said central portion is roller-shaped.

15. The improved coil carrier described in claim 12 wherein the ring member of said central portion is divided into a plurality of rings disposed in longitudinally parallel planes.

* * * * *